US007773042B2

(12) United States Patent
Yun et al.

(10) Patent No.: US 7,773,042 B2
(45) Date of Patent: Aug. 10, 2010

(54) CONICAL SCANNING ANTENNA SYSTEM USING NUTATION METHOD

(75) Inventors: Jae-Seung Yun, Daejon (KR); Soon-Young Eom, Daejon (KR); Young-Bae Jung, Daejon (KR); Seong-Ho Son, Daejon (KR); Soon-Ik Jeon, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 108 days.

(21) Appl. No.: 12/096,486

(22) PCT Filed: Aug. 25, 2006

(86) PCT No.: PCT/KR2006/003359

§ 371 (c)(1),
(2), (4) Date: Jun. 6, 2008

(87) PCT Pub. No.: WO2007/066874

PCT Pub. Date: Jun. 14, 2007

(65) Prior Publication Data

US 2008/0291102 A1 Nov. 27, 2008

(30) Foreign Application Priority Data

Dec. 8, 2005 (KR) ..... 10-2005-0119510

(51) Int. Cl.
*H01Q 3/12* (2006.01)

(52) U.S. Cl. ..... 343/761; 343/781 P; 343/781 CA

(58) Field of Classification Search ..... 343/761, 343/781 P, 781 CA
See application file for complete search history.

(56) References Cited

U.S. PATENT DOCUMENTS 4,041,500 A 8/1977 Lapp
4,305,075 A * 12/1981 Salvat et al. ..... 342/78
6,307,523 B1 10/2001 Green et al.
6,833,819 B2 * 12/2004 Lynch ..... 343/781 CA

FOREIGN PATENT DOCUMENTS

KR 10-2004-0057306 7/2004
WO 9960656 11/1999

OTHER PUBLICATIONS

International Search Report for PCT/KR2006/003359 Dated Nov. 23, 2006.

* cited by examiner

*Primary Examiner*—Tan Ho
(74) *Attorney, Agent, or Firm*—Jae Y. Park; Kile Goekjian Reed & McManus PLLC

(57) ABSTRACT

Provided is a conical scanning antenna system using a nutation method. The conical scanning antenna system includes: a main reflecting unit; a sub-reflecting unit which is disposed apart from the main reflecting unit by a predetermined distance and performing a conical scanning tracking by using the nutation method; and a feeding horn which doubly reflects electromagnetic wave inputted and radiated by the main reflecting unit and the sub-reflecting unit and inputs and outputs the electromagnetic wave by electrically steering beams.

6 Claims, 5 Drawing Sheets

[Fig. 1]
(RELATED ART)
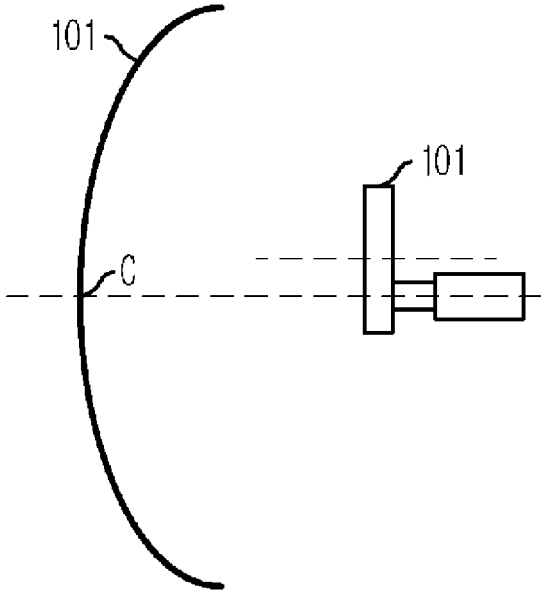
[Fig. 2]
(RELATED ART)
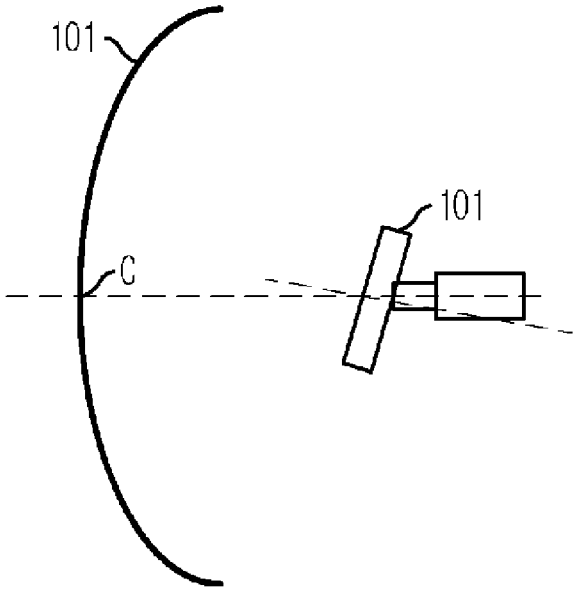

[Fig. 3]
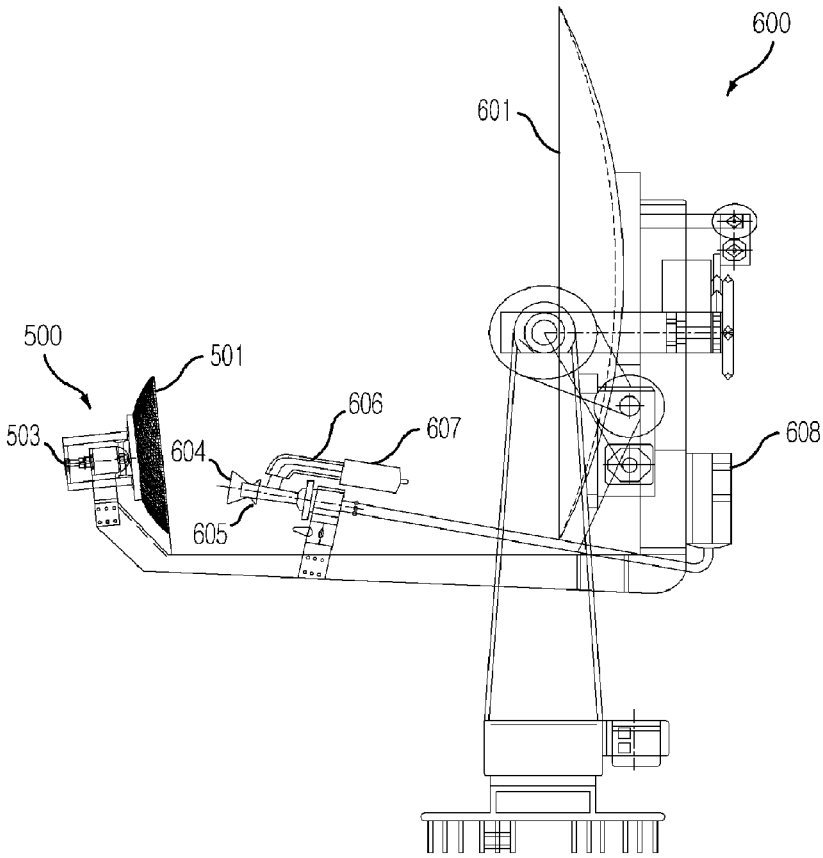
[Fig. 4]
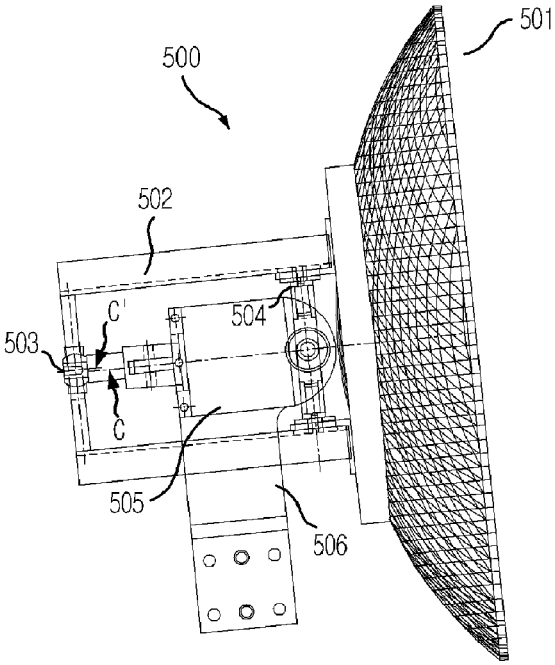

[Fig. 5]
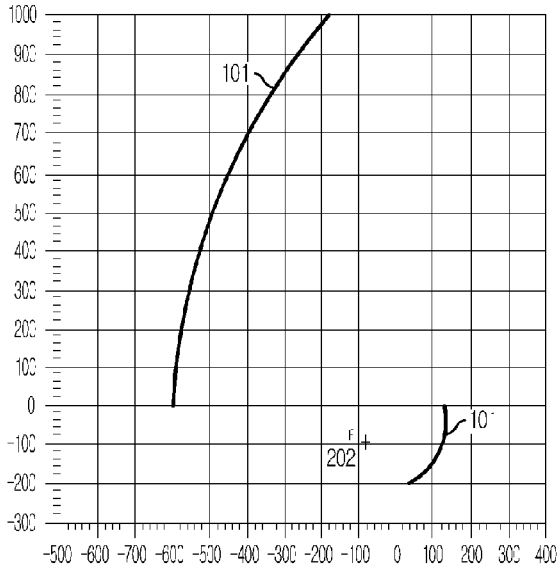
[Fig. 6]
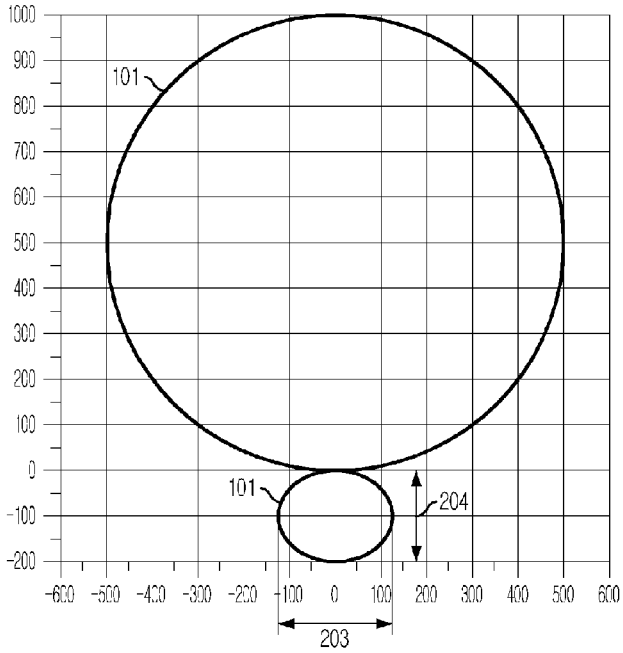
[Fig. 7]
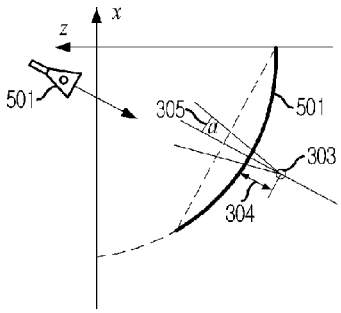

[Fig. 8]
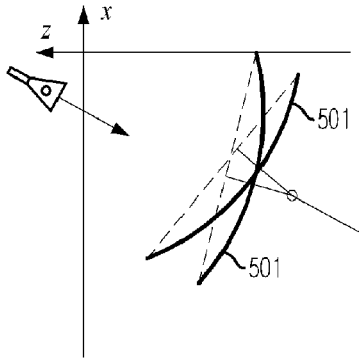
[Fig. 9]
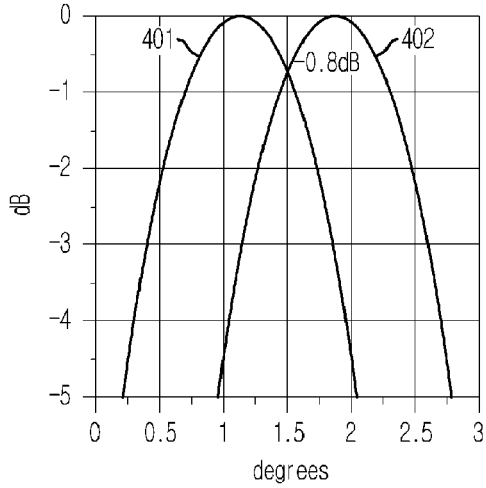
[Fig. 10]
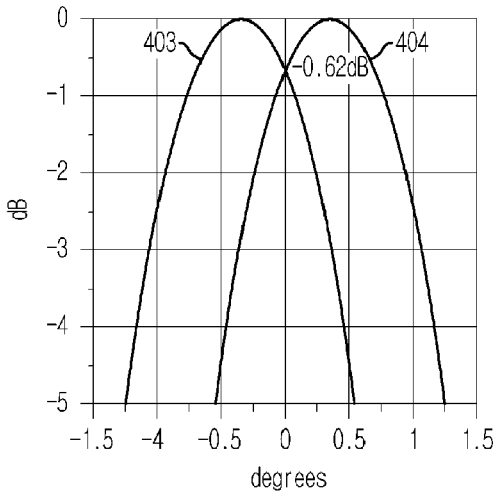

[Fig. 11]
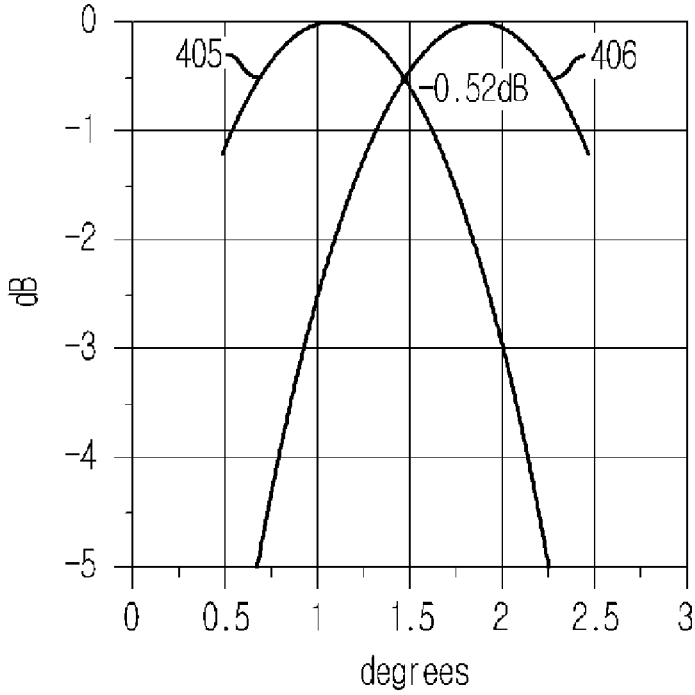
[Fig. 12]
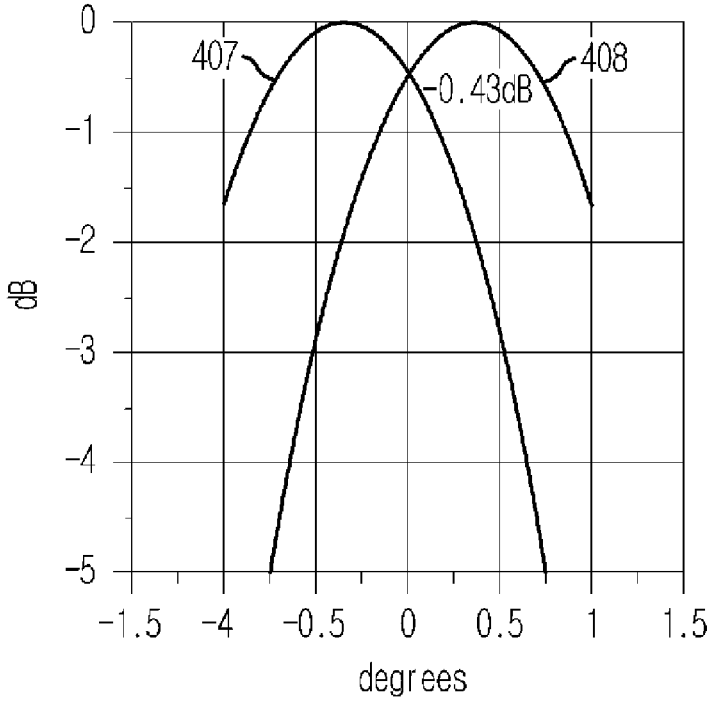

CONICAL SCANNING ANTENNA SYSTEM USING NUTATION METHOD

TECHNICAL FIELD

The present invention relates to a conical scanning antenna system using a nutation method; and more particularly to a conical scanning antenna system using a nutation method for effectively tracking a satellite by using a nutation method of a sub-reflector in an offset dual reflector antenna structure.

BACKGROUND ART

Generally, tracking algorithms for the satellite communication is classified into a closed loop method and an open loop method. The closed loop method is further classified into a lobing method and a mono-pulse method.

The closed loop method is designed to control the antenna in a predicted orbit direction by processing satellite orbit forecasting data, standard time data, and antenna digital angle data using a computer. Therefore, the tracking performance of the antenna depends on the accuracy of the data. The lobbing method is designed to control the orientation of the antenna by detecting a coming direction of a bicorn wave by moving a beam of the antenna using a predetermined method. The mono-pulse method is designed to detect an azimuth error on occasion in accordance with a radio wave with a single pulse in a state where the beam of the antenna is fixed.

The lobbing methods are further classified into a conical scanning method, a beam switching method, and a step tracking method. The conical scanning method is designed to rotate the beam of an antenna in a conical-shape having a minute angle to perform a closed tracking. The beam switching method is designed to determine a relative receiving signal level while discretely moving the beam to more than four pre-determined locations disposed around the axis of the antenna. The step tracking method is designed to move the beam in a direction where the receiving level is increased by checking the variation of the receiving level while moving the antenna by a minute angle in a step manner at a predetermined time interval.

FIGS. 1 and 2 show a conical scanning antenna having an offset dual reflector structure in accordance with the related art. In the concrete, a conventional method for implementing conical scanning using the rotation of a sub-reflector is shown.

FIG. 1 shows the central axis C of a sub-reflector 101 disposed to be deviated from the central axis C of the main-reflector 100. FIG. 2 shows the sub-reflector 101 tilted from the central axis C at a predetermined angle.

As shown in FIGS. 1 and 2, in order to implement the conical scanning using the rotation of the sub-reflector in a dual reflector antenna structure, the sub-reflector must have a circular shape with an axial symmetry characteristic.

However, offset dual reflector antenna systems generally employ a sub-reflector having a predetermined asymmetric shape to have an axial asymmetric characteristic in order to optimize the performance thereof. Therefore, the tracking method using the rotation of the sub-reflector may cause a tracking beam to have an asymmetry characteristic for an asymmetric axis.

DISCLOSURE OF INVENTION

Technical Problem

It is, therefore, an object of the present invention to provide a conical scanning antenna using a nutation method for tracking a satellite by nutating a sub-reflector in an offset dual reflector antenna structure.

Technical Solution

In accordance with one aspect of the present invention, there is provided a conical scanning antenna system using a nutation method of a sub-reflector in an offset dual reflector structure, the conical scanning antenna system including: a main reflecting unit; a sub-reflecting unit which is disposed apart from the main reflecting unit by a predetermined distance and performing a conical scanning tracking by using the nutation method; and a feeding horn which doubly reflects electromagnetic wave inputted and radiated by the main reflecting unit and the sub-reflecting unit and inputting and outputting the electromagnetic wave by electrically steering beams.

ADVANTAGEOUS EFFECTS

A conical scanning antenna system according to the present invention performs a satellite tracking function using a nutation method of a sub-reflector in an offset dual reflector antenna structure.

BRIEF DESCRIPTION OF THE DRAWINGS

The above and other objects and features of the present invention will become apparent from the following description of the preferred embodiments given in conjunction with the accompanying drawings, in which:

FIGS. 1 and 2 show a conical scanning antenna having an offset dual reflector structure in accordance with the related art;

FIG. 3 shows a conical scanning antenna using a nutation method in accordance with an embodiment of the present invention;

FIG. 4 is a view showing the sub-reflector of FIG. 3;

FIGS. 5 and 6 show a main reflector and a sub-reflector of a conical scanning antenna using nutation method in accordance with an embodiment of the present invention;

FIGS. 7 and 8 are views for describing the nutation motion made by the sub-reflector in the conical scanning antenna system in accordance with an embodiment of the present invention; and FIGS. 9 to 12 are graphs showing a tracking beam pattern made by nutation motion of a sub-reflector in a conical scanning antenna system in accordance with an embodiment of the present invention.

BEST MODE FOR CARRYING OUT THE INVENTION

Other objects and aspects of the invention will become apparent from the following description of the embodiments with reference to the accompanying drawings, which is set forth hereinafter.

FIG. 3 shows a conical scanning antenna system using a nutation method in accordance with an embodiment of the present invention, and FIG. 4 is a view showing a sub-reflector of FIG. 3.

Referring to FIGS. 3 and 4, the conical scanning antenna system includes a main reflecting unit 600, a sub reflecting unit 500 and a feeding horn 604 which doubly reflects electromagnetic wave inputted and radiated by the main reflecting unit and the sub-reflecting unit and inputs and outputs the electromagnetic wave by electrically steering beams. The main reflecting unit 600 has a parabola shaped main reflector 601 with a circular contour line.

As shown in FIG. 4, the sub reflecting unit 500 is disposed apart from the main reflecting unit by a predetermined distance and performing a conical scanning tracking by using the nutation method, and it includes a sub-reflector 501, a first supporting frame 502, a rotator 503, a second supporting frame 504, a motor 505 and a bracket 506.

The sub-reflector 501 has an oval contour line. The motor 505 is connected to the bracket 506 and the rotator 503 is connected to the one end of the motor 505. The rotator 503 is mounted at the first supporting frame 502 to enable the sub-reflector 501 to nutate. The second supporting frame 504 is formed in a ring shape. The ring shaped second supporting frame 504 is connected to the one end of the first supporting frame 502 to support the first supporting frame 501. It is preferable that the rotator 503 may be formed of bearings.

Also, the motor 505 and the rotator 503 are disposed to align the extension lines of the central shaft C of the motor 505 and the central shaft C of the rotator 503 to be met at the central shaft of the second supporting frame. Furthermore, the central shaft of the motor 505, which is the central axis of the sub-reflector 501, is separated from the central shaft of the rotator 503 by about 15 mm and tilted at an angle of 0.76.

The second supporting frame 504 connected to the first supporting frame 502 functions as a fixing unit by rotation motions made by the rotator 503, and the sub-reflector makes a nutation motion as a motion eccentric to the central point of the motor.

Furthermore, the conical scanning antenna system according to the present embodiment further includes an orthogonal polarization mode separator 605, a receiving band filter 606, a low-noise downlink frequency converter 607, and a high-power uplink frequency converter 608.

The orthogonal polarization mode separator 605 is for transmitting and receiving a signal. The receiving band filter 606 suppresses a transmit signal not to inflow into a receiving band. The low-noise downlink frequency converter 607 performs low-noise amplification and down-conversion to transform a signal into an intermediate frequency signal, and the high-power uplink frequency converter 608 up-converts the transmit band intermediate frequency signal and performs the high-power amplification on the up-converted signal.

FIGS. 5 and 6 show a main reflector and a sub-reflector of a conical scanning antenna system using nutation method in accordance with an embodiment of the present invention. FIG. 5 is a side view and FIG. 6 is a front view of the conical scanning antenna system in accordance with an embodiment of the present invention. As shown in FIGS. 5 and 6, it is preferable to form the sub-reflector 501 not to block the main reflector 601 and to have a left-to-right shaft 203 longer than a top-to-bottom shaft 204 for maximizing the efficiency of tracking the satellite. Also, it is preferable to form the main reflector 601 to have a parabola shape and a circular contour line for conveniently manufacturing the main reflector 601.

Comparing with the conventional on-set antenna or the signal reflector, electric wave blockage caused by a sub-reflector and supporting frames is minimized so as to increase the efficiency thereof. The feeding horn is disposed at a focus point 202 for electric feeding.

FIGS. 7 and 8 are views for describing the nutation motion made by the sub-reflector in the conical scanning antenna system in accordance with an embodiment of the present invention. FIG. 7 is a front view of the feeding horn 604 and the sub-reflector 501 in a normal mode, and FIG. 8 is a front view of the sub-reflector 501 in top and bottom conical-scanning mode.

More concretely, the feeding horn 604 is disposed at a focus point, and the nutation motion of the sub-reflector 501 is decided by a distance 304 between a center point 303 and the sub-reflector 501 and an offset angle 305 from the central point for the nutation motion. FIG. 7 shows the sub-reflector nutated at a top offset angle and the sub-reflector nutated at bottom offset angle from the center point 303. The sub-reflector has at an offset angle 305 from the central point to the top direction and to the bottom direction. That is, the sub-reflector is tilted to the top direction and to the bottom direction in a view of top-to-bottom direction.

The sub-reflector also has a predetermined offset angle to the left and to the right when a conical scanning is performed from the left to the right. That is, the sub-reflector has a predetermined sub-reflector angle tilted at a predetermined axis direction, and the sub-reflector makes the nutation motion while moving in the axis direction for a predetermined time.

If the oval sub-reflector rotates at 90 from the top/bottom tracking to the left/right tracking according to the conventional rotating motion, the oval sub-reflector becomes unable to form identical beam patterns for tracking a satellite because the longitudinal axis and the short axis of the oval circle of the sub-reflector are reversed.

The sub-reflector according to the present embodiment makes the nutation motion at about 15 mm of a gap 304 from the center point 303 of the sub-reflector with 0.76 of a tilting angle 305.

FIGS. 9 to 12 are graphs showing a tracking beam pattern made by nutation motion of a sub-reflector in a conical scanning antenna system in accordance with an embodiment of the present invention. To be specific, FIG. 9 shows a bottom tracking beam pattern 401 and a top tracking beam pattern 402, which are elevation angle tracking beam patterns at a transmit frequency of 14.5 GHz. The peak of the top/bottom beam pattern is created at about 0.5 from the decided nutation motion parameter. Also, a beam pattern level has a −0.8 dB at the crossing point of the top/bottom tracking beam pattern compared to the peak thereof.

FIG. 10 shows a left tracking beam pattern 403 and a right tracking beam pattern 405 formed by the nutation motion of the sub-reflector with a nutation tilting angle of 0.76 as an azimuth angle tracking beam pattern. As shown, the left and right tracking beam pattern 403 and 404 have small shifting amount of the top and bottom tracking beams. Also, the beam pattern level at the crossing point of the left and right tracking beam pattern 403 and 404 is about −0.62 dB compared to the peak thereof. It is because that the right to left diameter 203 of the sub-reflector is slightly larger than the top to bottom diameter 204 of the sub-reflector for the identical nutation tilt angle. It is possible to make the tracking beam tilt angle identical for all axes by changing the nutation tilt angle. However, it is preferable to make the nutation tilt angel to be identical for all axes for simplifying the structure of the antenna.

FIG. 11 shows a bottom tracking beam pattern 405 and a top tracking beam patter 406 as an elevation tracking beam at 11.7 GHz of a receiving frequency. Actually, the satellite tracking beam is formed at a receiving frequency band. In the present embodiment, the nutation parameter is extracted according to FIG. 4 in order to make the nutation motion along a predetermined axis to have about −0.5 dB at a normal mode compared to the peak thereof.

FIG. 12 shows left and right azimuth angle tracking beam patterns 407 and 408. In FIGS. 11 and 12, the crossing points of the top and bottom beam patterns, and the left and right beam patterns are about −0.5 dB compared to the peak thereof.

The present application contains subject matter related to Korean patent application No. 2005-119510, filed with the Korean Intellectual Property Office on Dec. 8, 2005, the entire contents of which is incorporated herein by reference.

While the present invention has been described with respect to certain preferred embodiments, it will be apparent to those skilled in the art that various changes and modifications may be made without departing from the scope of the invention as defined in the following claims.

What is claimed is:

1. A conical scanning antenna system using a nutation method of a sub-reflector in an offset dual reflector structure, the conical scanning antenna system comprising:

a main reflecting unit;

a sub-reflecting unit performing a conical scanning tracking by using the nutation method; and a feeding horn, wherein the sub-reflecting unit comprises:

a sub-reflector;

a first supporting frame for supporting the sub-reflector and housing a motor; and a rotating member connected to a shaft of the motor and mounted at the first supporting frame, wherein a central shaft of the motor is aligned with a central axis of the sub-reflector.

2. The conical scanning antenna system as recited in claim 1, wherein the sub-reflector further comprises:

a second supporting frame disposed at a position where extension lines of the shaft of the motor and a central shaft of the rotating member meet, and connected to upper and lower elements of the first supporting frame and fix the first supporting frame.

3. The conical scanning antenna system as recited in claim 2, wherein the sub-reflector has an oval contour line.

4. The conical scanning antenna system as recited in claim 2, wherein the central shaft of the rotating member is separated from the one end of the shaft of the motor by a predetermined distance, and the central shaft of the rotating member and the shaft of the motor are titled at a predetermined offset angle.

5. The conical scanning antenna system as recited in claim 4, wherein the central shaft of the rotating member is separated from the one end of the shaft of the motor by about 15 mm, and the central shaft of the rotating member and the shaft of the motor are titled at an offset angle of 0.76.

6. The conical scanning antenna system as recited in claim 1, further comprising:

an orthogonal polarization mode separator for transmitting and receiving a signal;

a receiving band filter for suppressing a transmit signal not to inflow into the receiving band;

a low-noise downlink frequency converter for performing a low-noise amplification and a down conversion on a radio frequency signal; and a high-power uplink frequency converter for up-converting a transmit band intermediate frequency signal and amplifying the converted signal.

* * * * *